US006719193B2

(12) United States Patent
Katulka

(10) Patent No.: US 6,719,193 B2
(45) Date of Patent: Apr. 13, 2004

(54) MAILBOX WITH INTERNAL LIGHT SOURCE DIRECTING LIGHT THROUGH TRANSLUCENT ADDRESS PANELS OR BOX WALLS

(76) Inventor: Michael A. Katulka, 2300 SW. 154th Ave., Davie, FL (US) 33326

( * ) Notice: Subject to any disclaimer, the term of this patent is extended or adjusted under 35 U.S.C. 154(b) by 0 days.

(21) Appl. No.: 10/092,398

(22) Filed: Mar. 6, 2002

(65) Prior Publication Data

US 2003/0168506 A1 Sep. 11, 2003

(51) Int. Cl.[7] ..... B65D 91/00
(52) U.S. Cl. ..... 232/38; 232/34; 40/566
(58) Field of Search ..... 232/38, 34, 17; 40/566; 362/155, 154

(56) References Cited

U.S. PATENT DOCUMENTS

| | | | | | |
|---|---|---|---|---|---|
| 1,657,967 | A | * | 1/1928 | Kichline | 40/566 |
| 1,659,351 | A | * | 2/1928 | Buccini | 232/19 |
| RE17,418 | E | * | 8/1929 | Lodge | 40/566 |
| 1,764,674 | A | * | 6/1930 | Beck | 40/566 |
| 1,789,239 | A | * | 1/1931 | Landgraf | 40/566 |
| 1,801,962 | A | * | 4/1931 | Kerr | 40/566 |
| 1,976,117 | A | * | 10/1934 | Cassel | 340/569 |
| 2,053,588 | A | * | 9/1936 | Voepel | 40/580 |
| 2,452,667 | A | * | 11/1948 | Lambert | 40/566 |
| 2,477,379 | A | * | 7/1949 | Korth | 232/34 |
| 2,648,152 | A | * | 8/1953 | Simpson | 40/576 |
| 5,346,125 | A | * | 9/1994 | Critzer, Sr. | 232/17 |
| 5,460,325 | A | * | 10/1995 | Surman | 232/17 |
| 5,522,540 | A | * | 6/1996 | Surman | 232/17 |
| 5,649,378 | A | * | 7/1997 | Roesser et al. | 40/559 |
| D385,677 | S | * | 10/1997 | Vivirito, Jr. | D99/29 |
| 6,299,325 | B1 | * | 10/2001 | Cathel | 362/183 |

* cited by examiner

*Primary Examiner*—William L. Miller
(74) *Attorney, Agent, or Firm*—Frank L. Kubler

(57) ABSTRACT

A mailbox includes a box having a box wall with a panel opening, the panel opening being fitted with a translucent panel marked with indicia; an electric power source; a light source secured relative to the box and positioned to radiate light from within the box through the translucent panel to enhance visibility of the indicia; and a light source circuit electrically interconnecting the power source and the light source.

15 Claims, 3 Drawing Sheets

MAILBOX WITH INTERNAL LIGHT SOURCE DIRECTING LIGHT THROUGH TRANSLUCENT ADDRESS PANELS OR BOX WALLS

BACKGROUND OF THE INVENTION

1. Field of the Invention

The present invention relates generally to the fields of mailboxes and address markers. More specifically the present invention relates to a mailbox, including the box itself such as the type mounted on a post, an electric power source, a box internal light source, a light source circuit electrically interconnecting the power source and the light source, the box having a box wall with at least one panel opening fitted with a translucent panel printed with owner identifying indicia through which light radiated by the light source passes to illuminate the identifying indicia. The panel preferably is formed of a white plastic which is diffuse and non-transparent so that the light source causes the panel to glow, and the indicia preferably includes address numbers or an owner name.

The light source circuit preferably includes a photocell mounted to the exterior of the box and connected to a photocell operated switch for closing the circuit and thereby activating the light source when ambient light diminishes, such as at sundown or during a storm. The photocell preferably is secured to the rear portion of the box so that automobile and street lights do not strike the photocell and cause deactivation of the light source.

2. Description of the Prior Art

There have long been mailboxes marked with address indicia such as numbers and sometimes the owner name or initials for identifying the party receiving mail through the given box and also for providing the street address of the house or business. A problem with address and name markings on mailboxes has been that they are difficult to read under low lighting conditions such as at night and during storms. Automobile headlights can illuminate address indicia on a mailbox, but only momentarily and often only partially, and thus insufficiently to permit reading of the indicia.

It is thus an object of the present invention to provide a mailbox which is marked with indicia and which includes lighting means fully and distinctly illuminating the indicia under low intensity ambient lighting conditions.

It is another object of the present invention to provide such a mailbox in which the lighting means is inactive under conditions of high intensity ambient lighting such as during a clear day and is automatically activated once the ambient light intensity drops below a certain preset magnitude.

It is still another object of the present invention to provide such a mailbox in which the indicia can be changed quickly and conveniently without damaging or otherwise altering the mailbox.

It is finally an object of the present invention to provide such a mailbox which is sturdy, reliable and relatively inexpensive to manufacture.

SUMMARY OF THE INVENTION

The present invention accomplishes the above-stated objectives, as well as others, as may be determined by a fair reading and interpretation of the entire specification.

A mailbox is provided, including a box having a box wall with a panel opening, the panel opening being fitted with a translucent panel marked with indicia; an electric power source; a light source secured relative to the box and positioned to radiate light from within the box through the translucent panel to enhance visibility of the indicia; and a light source circuit electrically interconnecting the power source and the light source.

The panel preferably is formed of diffuse, nontransparent plastic. The indicia preferably includes one of: address numbers and alphabetic letters.

The box wall has a box wall exterior surface and the light source circuit preferably includes a photocell and a photocell operated switch connected to the photocell, the photocell being mounted and oriented relative to the box wall exterior surface so that the photocell operated switch closes the circuit and thereby activates the light source when the intensity of ambient light outside the box falls below a certain minimum magnitude.

The box has a box rear portion and the photocell preferably is secured to the box rear portion. The box has a box top portion and the light source preferably is secured within the box within to the box top portion, so that mail within the box does not obstruct the passage of light from the light source to the translucent panel. The electric power source preferably includes one of: a battery mounted to a battery mounting structure; a power cable extending from the box to a remote power source; and a rechargeable battery electrically connected to a solar panel located outside the box.

The box preferably is formed of opaque material. Alternatively the box is formed of translucent and diffuse material so that substantially all of the box is illuminated by the light source.

The box wall preferably includes a box bottom wall, opposing first and second box side walls, a box top wall and a box back wall, the walls being interconnected to form a box enclosure, and a box door having a rearwardly extending sealing flange and being hingedly secured to the box bottom wall to pivot upwardly to fit against the box side walls and the box top wall so that the sealing flange fits snugly around the box side walls and the box top wall, thereby closing the box. The box top wall optionally includes a light source housing in the form of an inverted channel opening into the box and retaining the light source.

The panel opening preferably includes a panel mounting structure into which a corresponding panel is removably fitted to close the panel opening, the panel mounting structure preferably including two substantially parallel L-shaped track members mounted to a box side wall on opposing sides of the panel opening to each define a guide channel, the guide channels opening toward each other and spaced from each other and sized in width and length to slidingly receive the corresponding translucent panel. The mailbox preferably additionally includes a water seal between the given panel and the guide channels.

A mailbox is further provided, including a box formed of translucent plastic and having a box wall marked with indicia; an electric power source; a light source secured relative to the box and positioned to radiate light from within the box through the box wall to enhance visibility of the indicia; and a light source circuit electrically interconnecting the power source and the light source. The translucent plastic preferably is diffuse to diffuse light passing through the box.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
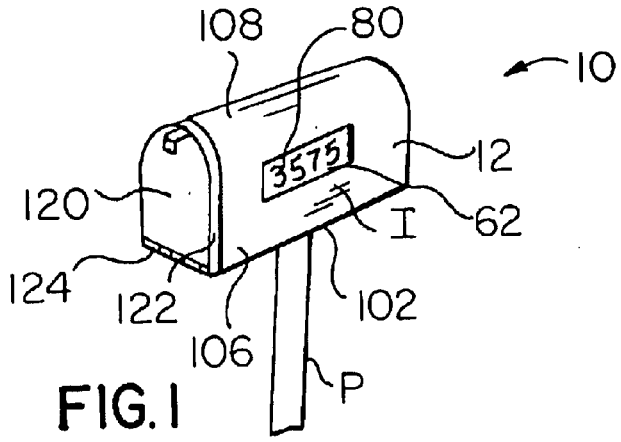
FIG. 1 is a perspective view of a first embodiment of the inventive mailbox, showing a panel opening in the box side wall fitted with a translucent panel marked with address numbers.
Figure 2:
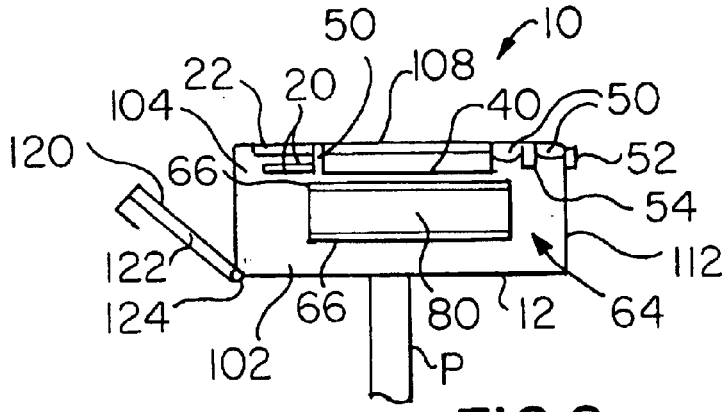
FIG. 2 is a cross-sectional side view of the mailbox of FIG. 1, showing the light source, power source in the form of batteries mounted in a battery mounting structure, a photocell mounted to the rear surface of the box and electrically connected to the light source circuit through a photocell switch.
Figure 3:
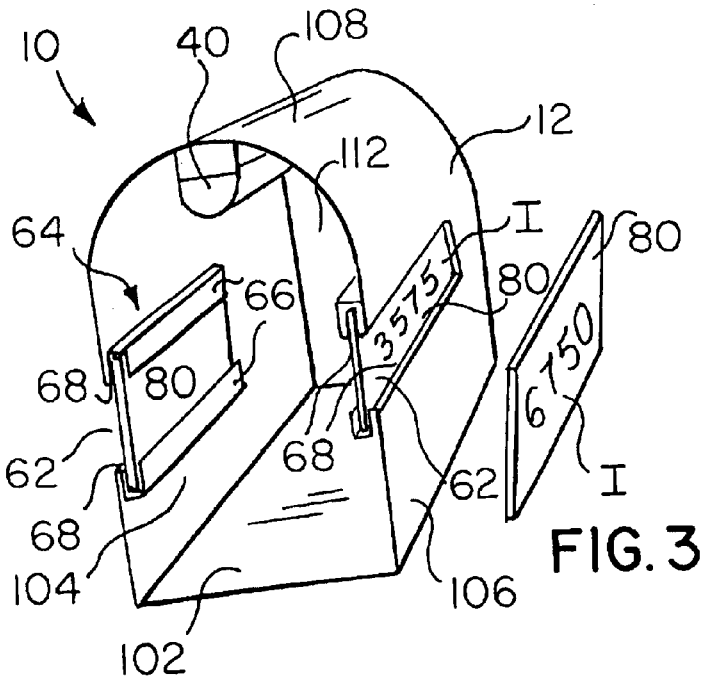
FIG. 3 is a cross-sectional perspective frontal view of the mailbox of FIGS. 1 and 2, revealing the preferred light source, a panel opening and panel mounting structure in each box side wall fitted with a translucent panel, and an extra translucent panel marked with different address numbers, indicating the ability to change address numbers.
Figure 4:
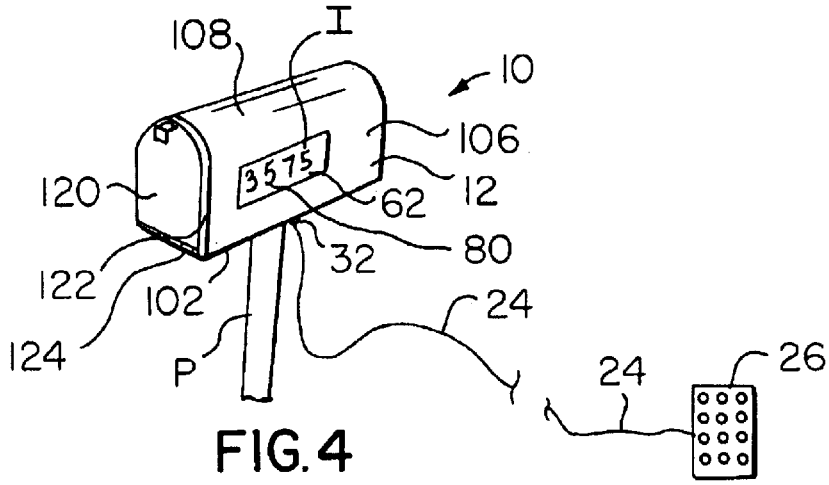
FIG. 4 is a perspective view of an embodiment of the mailbox having the power cord connected to a remote power source.
Figure 5:
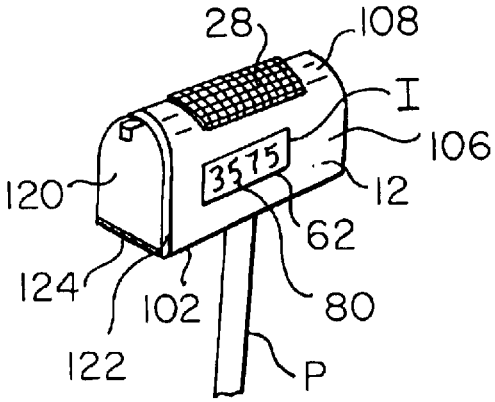
FIG. 5 is a perspective view of another embodiment of the mailbox, having a solar panel on its box top wall exterior surface.
Figure 6:
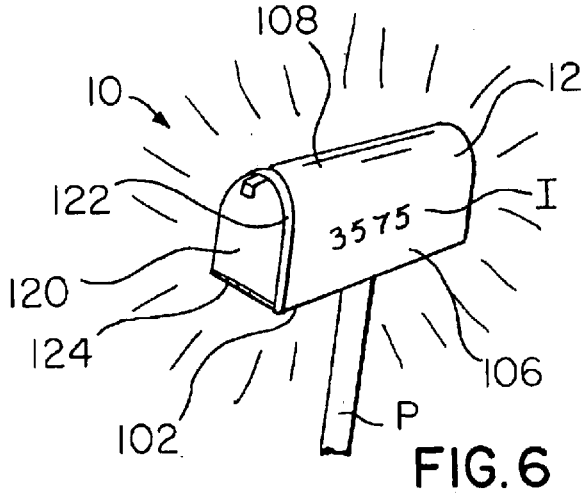
FIG. 6 is a perspective view of yet another embodiment of the mailbox which omits the panel openings and panels and in which the box itself is marked with the indicia and is formed of translucent plastic.
Figure 7:
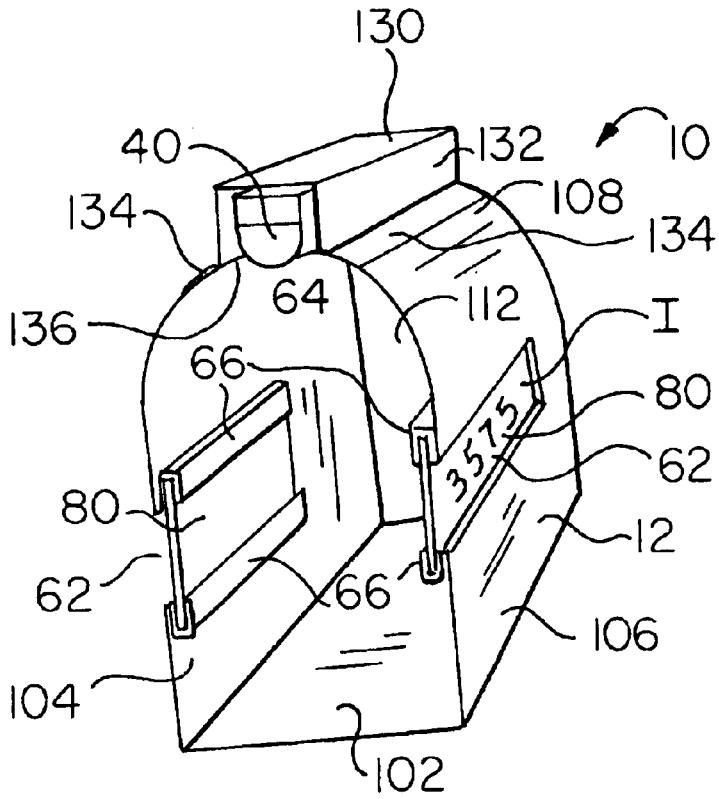
FIG. 7 is a cross-sectional perspective frontal view of another version of the first embodiment of the mailbox having the optional inverted channel light source housing.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–9, a mailbox 10 is disclosed, preferably mounted on a mailbox post P, the mailbox 10 including a box 12, an electric power source 20, a box internal light source 40, a light source circuit 50 electrically interconnecting the power source 20 and the light source 40, the box 12 having a box wall 60 with at least one panel opening 62 fitted with a translucent panel 80 marked with owner identifying indicia I through which light radiated by the light source 40 passes to illuminate the identifying indicia I. See FIGS. 1–3. The translucent panel 80 preferably is formed of a diffuse white plastic which is non-transparent, and the indicia I preferably includes address numbers or alphabetic letters which may form the owner name or initials.

Light source circuit 50 preferably includes a photocell 52 connected to a photocell operated switch 54, the photocell 52 being mounted to the exterior surface of the box 12 for closing the circuit and thereby activating the light source 40 when ambient light diminishes to a point below a preset level of intensity, such as at sundown or during a storm. The photocell 52 preferably is secured to the rear portion of the box 12 so that automobile and street lights do not strike the photocell 52 and cause deactivation of light source 40. See FIG. 2.

Light source 40 preferably is secured within the top portion of box 12 so that mail within box 12 does not obstruct the passage of light from the light source 40 to the translucent panel 80. The preferred light source 40 is a MINI-FLUORESCENT LITE™, part/catalog number P00-0040, manufactured by AMERICAN TACK & HARDWARE™ of Monsey, N.Y. Electric power source 20 may be one or more batteries replaceably mounted on battery mounting structure 22 including battery terminals, preferably within box 12, and alternatively includes a power cable 24 extending to a remote power source 26, and still alternatively may be a solar panel 28 mounted on the box 12 exterior and wired to a rechargeable battery. See FIGS. 1, 4 and 5. Where power source 20 includes a power cable 24, the cable 24 preferably passes out of box 12 through a cable port fitted with a cord grommet 32, extends down the mailbox post P or other support structure, and extends underground to a circuit box remote power source 26 in a nearby building.

Box 12 may be formed of aluminum, galvanized steel or any other suitable metal, or may be formed of a durable opaque plastic. Still alternatively, box 12 may be formed of a diffuse translucent plastic, so that the entire box 12 is illuminated by the light source 40, and the indicia I are either placed on one or more replaceable panels 80, or the panels 80 and panel openings 62 are omitted and the indicia I are printed or affixed directly to the sides of the box 12 itself. See FIG. 6.

A preferred embodiment of box 12 is horizontally elongated in depth and has a box bottom wall 102, opposing and upright first and second box side walls 104 and 106, respectively, a box top wall 108 and a box back wall 112, all interconnected, and a box door 120 having a rearwardly extending peripheral sealing flange 122 and hingedly secured with a hinge 124 to the box bottom wall 102 to pivot upwardly to fit against the forward edges of the box side and top walls 104, 106 and 108, respectively, so that the sealing flange 122 fits snugly around the exterior surfaces of the box side and top walls, and to pivot downwardly to open the box 12, thereby closing the box 12. See FIG. 3.

For smaller mailboxes 10, a light source housing 130 is optionally provided in the form of an inverted channel in the box top wall 108 for retaining the light source 40 and any battery 20, so that the relatively small mail receiving space in box 12 is not reduced. See FIG. 7. Where box 12 is a pre-existing model being adapted aftermarket to have the present inventive features, the housing 130 preferably takes the form of an inverted channel member 132 having lateral mounting flanges 134 sealingly fastened to the box top wall 108 over a longitudinal light source slot 136 in the box top wall 108. Alternatively, where box 12 is originally manufactured to include the present inventive features, an integral inverted channel 132 is formed as part of the box top wall 108 during box 12 manufacture.

Figure 8:
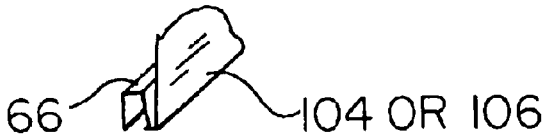
FIG. 8 is a broken away perspective view of a portion of the box side wall along the periphery of the panel opening, having an integral guide channel formed as part of the box side wall during box manufacture.
Figure 9:
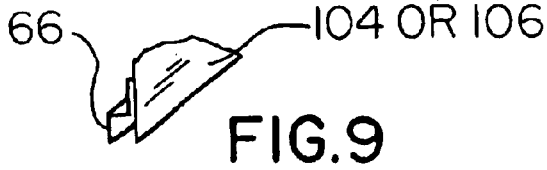
FIG. 9 is a broken away perspective view of a portion of the box side wall along the periphery of the panel opening, having an aftermarket added guide channel fastened to the existing box side wall after manufacture.

A horizontally elongated panel opening 62 preferably is provided in each box side wall 104 and 106, and each panel opening 62 includes a panel mounting structure 64 into which the corresponding panel 80 is removably fitted. The panel mounting structure 64 preferably includes two substantially parallel L-shaped track members mounted to the box side wall 104 or 106 on opposing sides of the panel opening 62 to define opposing guide channels 66 which open toward each other, and are spaced apart from each other, and sized to slidingly receive edges of the translucent panel 80. See FIG. 3. Guide channels 66 may be manufactured as integral parts of box 12 as shown in FIG. 8, or may have connection flanges 66*a* and fastened to the box 12 such as by welding, as shown in FIG. 9. A water seal 68 is provided between the panel 80 and its corresponding guide channel 66, such as a silicon sealer or a gasket sealer, to keep out water delivered by rain, lawn sprinklers and morning dew condensation.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A mailbox, comprising:

a translucent panel marked with indicia;

a box having a box wall comprising a box back wall and having a box exterior surface and a panel opening, said panel opening containing said translucent panel, and a box door opening at a front of said box; a box door pivotally connected to said box wall to open and close said box door opening, wherein said box wall is opposite said box door;

an electric power source;

a light source secured relative to said box and positioned to radiate light from within said box through said translucent panel to enhance visibility of said indicia;

and a light source circuit electrically interconnecting said power source and said light source;

said light source circuit comprising a photocell secured to said box back wall and a photocell operated switch connected to said photocell, said photocell being oriented such that said photocell operated switch closes said light source circuit and thereby activates said light source when the intensity of ambient light outside said box striking said box back wall falls below a certain minimum magnitude.

2. The mailbox of claim 1, where said panel is formed of diffuse, nontransparent plastic.

3. The mailbox of claim 1, wherein said indicia comprises one of: address numbers and alphabetic letters.

4. The mailbox of claim 1, wherein said box has a box top portion and wherein said light source is secured within said box within said box top portion, such that mail within said box does not obstruct the passage of light from said light source to said translucent panel.

5. The mailbox of claim 1, wherein said electric power source comprises one of: a battery mounted to battery mounting means; a power cable extending from said box to a remote power source; and a rechargeable battery electrically connected to a solar panel located outside said box.

6. The mailbox of claim 1, wherein said box is formed of opaque material.

7. The mailbox of claim 1, wherein said box is formed of translucent and diffuse material such that substantially all of said box is illuminated by said light source.

8. The mailbox of claim 1, wherein said box wall comprises a box bottom wall, opposing first and second box side walls, a box top wall and said box back wall, said box bottom wall, said opposing first and second box side walls said box back wall and said box top wall being interconnected to form a box enclosure, and said box door having a rearwardly extending sealing flange and being hingedly secured to said box bottom wall to pivot upwardly to fit against said box side walls and said box top wall such that said sealing flange fits snugly around said box side walls and said box top wall, thereby closing said box.

9. The mailbox of claim 8, wherein said box top wall comprises a light source housing in the form of an inverted channel opening into said box and retaining said light source.

10. The mailbox of claim 1, wherein said electric power source comprises a solar panel outside said box and secured to said box wall and a rechargeable battery electrically connected to said solar panel.

11. A mailbox, comprising:

a translucent panel marked with indicia;

a box having a box wall with a panel opening for containing said translucent panel;

an electric power source;

a light source secured relative to said box and positioned to radiate light from within said box through said translucent panel to enhance visibility of said indicia;

and a light source circuit electrically interconnecting said power source and said light source;

wherein said box wall comprises a box bottom wall, opposing first and second box side walls, a box top wall and a box back wall, said box bottom wall, said opposing first and second box side walls, said box back wall and said box top wall being interconnected to form a box enclosure, and comprising a box door having a rearwardly extending sealing flange and being hingedly secured to said box bottom wall to pivot upwardly to fit against said box side walls and said box top wall such that said sealing flange fits snugly around said box side walls and said box top wall, thereby closing said box;

wherein said panel opening comprises a panel mounting structure into which said panel is removably fitted to close said panel opening, said panel mounting structure comprising two substantially parallel L-shaped track members mounted to one of said box side walls on opposing sides of said panel opening to each define a guide channel, said guide channels opening toward each other and spaced from each other and sized in width to slidingly receive said translucent panel.

12. The mailbox of claim 11, additionally comprising a water seal between the given said translucent panel and said guide channels.

13. A mailbox, comprising:

a translucent panel marked with indicia and having opposing panel edges;

a box having a box wall comprising a panel opening for containing said translucent panel, said box wall further comprising a box bottom wall, opposing first and second box side walls, a box top wall and a box back wall, said box bottom wall, said opposing first and second box side walls, said box back wall and said box top wall being interconnected to form a box enclosure, and comprising a box door hingedly secured to said box bottom wall to pivot upwardly to fit against said box side walls and said box top wall, thereby closing said box, said panel opening comprising a panel mounting structure into which said panel is removably fitted to close said panel opening, said panel mounting structure mounted to one of said box side walls and comprising two guide channels opening toward each other and spaced from each other and sized in width to slidingly receive said opposing panel edges of said translucent panel;

an electric power source;

a light source secured relative to said box and positioned to radiate light from within said box through said translucent panel to enhance visibility of said indicia;

and a light source circuit electrically interconnecting said power source and said light source.

14. A mailbox, comprising:

a translucent panel marked with indicia;

a box having a box wall comprising a panel opening for containing said translucent panel, said box wall further comprising a box bottom wall, opposing first and second box side walls, a box top wall and a box back wall, said box bottom wall, first and second box side walls, said box back wall and said box top wall being interconnected to form a box enclosure, and comprising a box door hingedly secured to said box bottom wall to pivot upwardly to fit against said box side walls and said box top wall, thereby closing said box, said panel opening comprising a panel mounting structure into which said panel is fitted to close said panel opening;

an electric power source;

a light source secured relative to said box and positioned to radiate light from within said box through said translucent panel to enhance visibility of said indicia;

a light source housing in the form of an inverted channel opening into said box top wall and retaining said light source, said inverted channel protruding upwardly from said box top wall such that said inverted channel does not reduce space for mail within said box;

and a light source circuit electrically interconnecting said power source and said light source.

15. A mailbox, comprising:

a translucent panel marked with indicia;

a box having a box wall comprising a box back wall and having a box exterior surface and a panel opening, said panel opening containing said translucent panel, and a box door opening at a front of said box;

a box door pivotally connected to said box wall to open and close said box door opening, wherein said box back wall is opposite said box door;

an electric power source;

a light source secured relative to said box and positioned to radiate light from within said box through said translucent panel to enhance visibility of said indicia;

and a light source circuit electrically interconnecting said power source and said light source;

said light source circuit comprising a photocell secured to said box wall and a photocell operated switch connected to said photocell, said photocell being oriented such that said photocell operated switch closes said light source circuit and thereby activates said light source when the intensity of ambient light outside said box striking said box wall falls below a certain minimum magnitude; and said box comprising a light obstruction means forwardly of said photocell for obstructing light directed toward said front of said box.

* * * * *